US005424617A

United States Patent [19]

Garbowicz et al.

[11] Patent Number: 5,424,617

[45] Date of Patent: Jun. 13, 1995

[54] HID LAMP IGNITOR-TIMER WITH AUTOMATIC RESET FOR DIPS IN LINE VOLTAGE

[75] Inventors: Glenn D. Garbowicz, Rosemont; Patrick S. Gorman, Chicago; Seymour Perkins, III, Hinsdale, all of Ill.

[73] Assignee: North American Philips Corporation, New York, N.Y.

[21] Appl. No.: 23,539

[22] Filed: Feb. 26, 1993

[51] Int. Cl.[6] ..... H05B 37/00

[52] U.S. Cl. ..... 315/289; 315/119; 315/DIG. 7

[58] Field of Search ..... 315/119, 289, 290, 360, 315/DIG 5, DIG 7

[56] References Cited

U.S. PATENT DOCUMENTS 4,107,579 8/1978 Bodine, Jr. et al. ..... 315/205
4,665,346 4/1987 Tarroux ..... 315/289
4,949,018 8/1990 Siglock ..... 315/225
4,962,336 10/1990 Dodd et al. ..... 315/290
5,070,279 12/1991 Garbowicz et al. ..... 315/289

FOREIGN PATENT DOCUMENTS 1598450 9/1981 United Kingdom .

*Primary Examiner*—Tony M. Argenbright
*Attorney, Agent, or Firm*—Edward Blocker; Bernard Franzblau

[57] ABSTRACT

A high intensity discharge ballast having an ignitor which shuts off after a predetermined time period has elapsed. The ballast is sensitive to voltage dips in power line voltage and resets a timer whenever the power line voltage drops below a level sufficient for lighting a lamp load. Restart of the lamp load immediately following restoration of power line voltage is achieved without requiring that the power line voltage be removed from the ballast or otherwise reduced to approximately 0 volts before restart can be initiated.

28 Claims, 1 Drawing Sheet

HID LAMP IGNITOR-TIMER WITH AUTOMATIC RESET FOR DIPS IN LINE VOLTAGE

BACKGROUND OF THE INVENTION

This invention relates generally to a high intensity discharge (HID) lamp ignition scheme, and more particularly to an ignition scheme for restarting an HID lamp.

An HID lamp generally refers to lamps of the high pressure mercury, high pressure sodium, metal halide, high pressure metal vapor and low pressure sodium types. An HID lamp is ignited through application of a high voltage pulse, nominally of several thousand volts, across the electrodes of the lamp. The high voltage pulses are produced by pulsed ignition circuits (i.e. ignitors). Many conventional ignitors operate continuously, that is, applying at least one ignition pulse across the lamp socket(s) every half cycle of the AC line voltage until the lamp lights. Continuous generation of high voltage pulses applied across the lamp socket(s) when no longer required (e.g. when the lamp has been previously removed from the socket(s) or has already failed (burned out)) subjects the ballast insulation and components to undue stress:

In order to control and thereby limit the time during which the high voltage pulses are generated by the ignitor, timer circuits within the ballast, such as disclosed in U.S. Pat. No. 5,070,279, have been employed. In such circuits (hereinafter referred to as shut-off type ignitors), the timer is set to activate the ignitor for a short, predetermined period after power is first applied to the lamp fixture and to thereafter disable operation of the ignitor until line power has been removed and then reapplied. Possible voltage stress on both the ballast insulation and components which might otherwise occur through continuous generation of ignition pulses is therefore reduced. This shut-off type ignition scheme, however, does not reignite the HID lamp when a voltage dip (transient) occurs sufficient to turn OFF the lamp but not low enough to reset the timer. The inability of a conventional shut-off type ignition scheme to attempt reignition of the lamp following extinction due to the aforementioned dip in line voltage is a serious drawback.

Shut-off type ignition schemes, such as disclosed in U.S. Pat. No. 5,070,279, also require the timer circuit to be powered based on the voltage applied to the lamp. No one timer circuit can be used for controlling ignitors which vary in ignition pulse amplitude and/or length of time during which the ignition pulses are generated since the timer circuit components must vary based on the nominally rated HID lamp voltage.

Accordingly, it is desirable to provide an HID ballast having a shut-off type ignition scheme which is sensitive to all dips (transients) in line voltage resulting in lamp arc extinction. The shut-off type ignition scheme also should be compatible for use with different types of HID lamps regardless of the nominally rated HID lamp voltage.

SUMMARY OF THE INVENTION

Generally speaking, in accordance with the invention, a ballast for powering a lamp load includes a power source for producing an output voltage, an ignitor for generating ignition pulses based on the output voltage and a timing device for controlling when the ignition pulses are to be generated. The ballast also includes a voltage sensor for sensing whenever the output voltage is sufficient and insufficient for lighting the lamp load. The timing device, in response to the voltage sensor sensing an output voltage insufficient for lighting the lamp load followed by an output voltage sufficient for lighting the lamp load, is operable for initiating generation of the ignition pulses.

The present invention is therefore automatically operable for restarting the lamp load whenever the output voltage momentarily drops below a level sufficient for lighting the lamp load followed by restoration of an output voltage sufficient for lighting the lamp load. Advantageously, the ballast in accordance with the invention need not wait until line power has been removed and then reapplied to the ballast before restarting the lamp load.

It is a feature of the invention that the voltage sensor be operable for resetting the timing device based on the output voltage being insufficient to light the lamp load and for setting the timing device based on the output voltage being sufficient to light the lamp load. The voltage sensor preferably includes a capacitor and resistor connected together in parallel.

The timing device generally includes a switch for placing the ignitor in serial combination with the switch across the lamp load. In a preferred embodiment of the invention, the timing device also includes an optocoupler and a timer. The optocoupler is coupled between the timer and switch. The switch typically is a triac having a gate connected to the optocoupler.

Preferably, the power source is connected across the lamp load and the voltage sensor is connected to and is powered by the power source for monitoring a predetermined portion of the output voltage. When the power source includes a transformer having a primary winding with at least one tap, the voltage sensor is connected to and monitors the voltage at the tap rather the voltage across the lamp (as in conventional shut-off type ignitors). It is therefore not necessary to design the timing circuit based on the nominally rated lamp voltage as in conventional shut-off type ignition schemes.

In accordance with another aspect of the invention, the method for ballasting a lamp load includes producing a lamp voltage, generating ignition pulses for igniting the lamp load and controlling when the ignition pulses are to be applied to the lamp load. The method further includes the step of sensing whenever the lamp voltage is sufficient and insufficient to light the lamp load. In response to sensing whenever a lamp voltage is first insufficient to light the lamp load followed by sensing when a lamp voltage is sufficient to light the lamp load, ignition pulses are generated for ignition of the lamp load.

Accordingly, it is an object of the invention to provide an improved HID lamp ballast shut-off type ignition scheme which restarts the lamp as soon as possible following lamp arc extinction due to a dip in power line voltage.

It is another object of the invention to provide an improved HID lamp ballast shut-off type ignition scheme which avoids a built-in delay based on power line voltage prior to restarting the lamp.

It is a further object of the invention to provide an improved HID lamp ballast shut-off type ignition scheme which can be used regardless of the type of HID lamp to be ignited.

Still other objects and advantages of the invention will, in part, be obvious, and will, in part, be apparent from the specification.

The invention accordingly comprises several steps and the relation of one or more of such steps with respect to each of the others, and the device embodying features of construction, combination of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawing in which.

DETAILED DESCRIPTION OF THE PREFERRED EMBODIMENT

Figure 1:
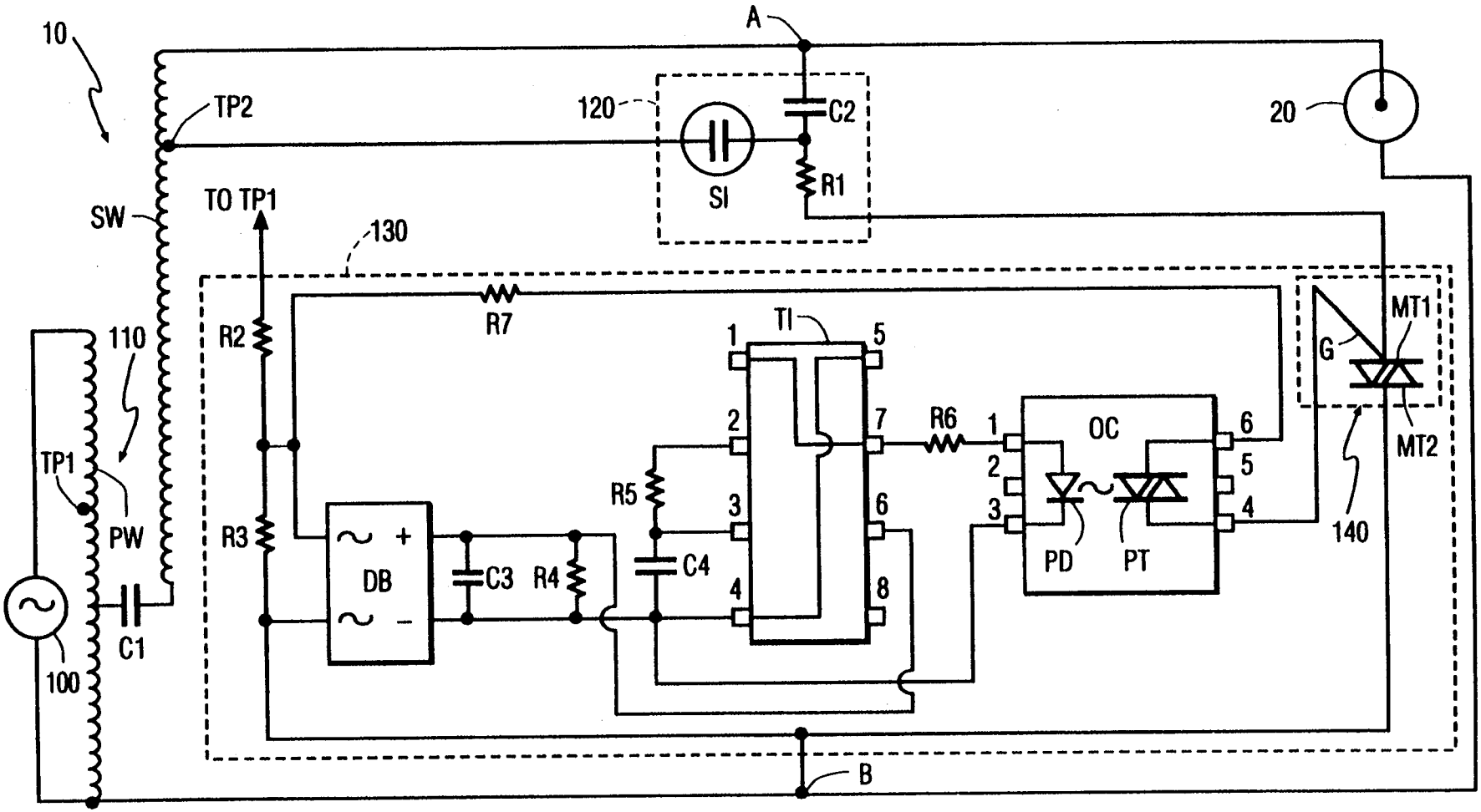
FIG. 1 is an HID lamp ballast in accordance with the invention.

A ballast 10 for supplying power to a lamp load 20 includes an AC voltage source 100 connected across a primary winding PW of a transformer 110. Primary winding PW includes at least one tap TP1. Transformer 110 is preferably, but not limited, to an autotransformer type that includes a secondary winding SW with a power factor, current limiting capacitor C1 serially connected between primary winding PW and secondary winding SW. Secondary winding SW includes a tap TP2.

Ballast 10 also includes an ignitor 120 and a combined voltage sensing timing unit 130. Ignitor 120 includes a sidac SI connected at one end to a junction joining a capacitor C2 and a resistor R1 together and at the other end to tap TP2. Capacitor C2 is also connected to a junction joining secondary winding SW and lamp load 20 together (hereinafter referred to as node A). Resistor R1 is also connected to a switch 140 of voltage sensor/timer unit 130. Switch 140 can be, for example, a triac having a pair of main terminals MT1 and MT2 and a gate G. Resistor R1 is connected to main terminal MT1.

Voltage sensor/timer unit 130 also includes a voltage divider network formed by a resistor R2 and resistor R3. Resistor R2 is connected at one end to tap TP1 of primary winding PW and at its other end to a junction joining together resistors R3 and R7 and an AC input of a full wave diode bridge rectifier DB. The other end of resistor R3 is connected to a junction joining together the other AC input of diode bridge rectifier DB, main terminal MT2 of switch 140, lamp load 20, primary winding PW and AC source 100 (hereafter referred to as node B). Diode bridge rectifier DB includes a positive output and a negative output across which are connected in parallel a capacitor C3 and a resistor R4.

A timer TI includes 8 pins. Connected between pins 2 and 3 is a resistor R5. Connected between pins 3 and 4 is a capacitor C4. The junction joining pin 4 and capacitor C4 together is also connected to resistor R4, capacitor C3, the negative output of diode bridge rectifier DB and a pin 3 of an optocoupler OC. Pins 1 and 7 of timer TI are connected together. Pins 4 and 5 of timer TI are also connected together. Pin 6 of timer TI is connected to the junction joining together capacitor C3, resistor R4 and the positive output of diode bridge rectifier DB. Pin 7 of timer TI is connected through a resistor R6 to a pin 1 of optocoupler OC.

Optocoupler OC has 6 pins and includes a photodiode PD connected between pins 1 and 3. Connected between pins 4 and 6 of optocoupler OC is a phototriac PT. Phototriac PT is a light activated bilateral switching element. Pin 4 of optocoupler 0C is also connected to gate G of switch 140. Pin 6 of optocoupler OC is connected to resistor R7.

Operation of ballast 10 is as follows. An AC voltage produced by AC source 100 is applied to primary winding PW which induces a voltage across secondary winding SW. Capacitor C1 power factor corrects the a.c. current drawn by ballast 10 and limits the current flowing into secondary winding SW.

Resistors R2 and R3 serve as a voltage divider so that a relatively small voltage is applied to the AC input terminals of diode bridge rectifier DB. The voltage applied across the AC input terminals of diode bridge rectifier DB represents the voltage across primary winding PW and, through transformation, the voltage applied to lamp load 20. The output of diode bridge DB is a rectified AC voltage which is smoothed by capacitor C3. In particular, the voltage produced by diode bridge rectifier DB is a rectified AC voltage having substantial ripple. Capacitor C3 serves to filter the rectified AC voltage so that a substantially smooth DC voltage is supplied to timer TI.

The DC voltage across capacitor C3 is fed into pins 4 and 6 of timer TI. Resistor R5 and capacitor C4 determine the time constant (i.e countdown sequence) for timer TI. For example, when lamp load 20 is an HID lamp of the high pressure sodium type, the R5-C4 time constant is typically approximately 3 minutes. When lamp load 20 is an HID lamp of the metal halide type, the R5-C4 time constant is typically approximately 15 minutes.

Prior to timer TI completing its countdown sequence based on the R5-C4 time constant, pin 7 is at a high logic level. After completing the countdown sequence, pin 7 assumes a low logic level. When pin 7 of timer TI is at a high logic level, a current limited by resistor R6 flows through photodiode PD. Photodiode PD and phototriac PT are optically coupled together. Consequently, current flowing through photodiode PD triggers phototriac PT into its conductive (ON) state. Current flowing through resistor R7 limits, in part, the current flowing through phototriac PT when the latter is turned ON. The current flowing through phototriac PT, limited predominantly by resistor R7, is sufficient to produce a voltage at gate G to turn ON switch 140.

When switch 140 closes, the AC voltage potential between nodes A and B is placed across the serial combination of capacitor C2, resistor R1 and switch 140 resulting in the charging of capacitor C2. The voltage across capacitor C2 increases until the breakover voltage of sidac SI is reached. Capacitor C2 now rapidly discharges through that portion of secondary winding SW between tap TP2 and node A. By transformer action, the voltage pulse produced during discharge of capacitor C2 is stepped up by transformer 110 to provide an ignition pulse for igniting lamp load 20. Following discharge, capacitor C2 once again begins to charge until reaching the breakover voltage of sidac SI. Capacitor C2 once again rapidly discharges resulting in the generation of an ignition pulse applied to lamp load 20. The foregoing sequence of charging and discharging of capacitor C2 resulting in the generation of ignition pulses continues until the countdown sequence of timer TI is complete or lamp load 20 ignites.

When the countdown sequence set by resistor R5 and capacitor C4 has been completed, pin 7 assumes a low logic level resulting in an insufficient level of current flowing through photodiode PD to turn ON phototriac PT of optocoupler OC. Switch 140 and therefore ignitor 120 are now turned OFF. When lamp load 20 ignites, the voltage across sidac SI drops below its breakover voltage thereby turning OFF ignitor 120. Therefore, if prior to completing the countdown sequence lamp load 20 ignites, ignitor 120 will be turned OFF.

When voltage transients occur in the power line, that is, appear across the input of primary winding PW, lamp load 20 can turn OFF. More particularly, an insufficient voltage is temporarily applied across primary winding PW resulting in an insufficient voltage applied across lamp load 20 to maintain the lamp arc of the latter.

Of particular importance is resistor R4 which, by being in parallel with capacitor C3, permits capacitor C3 to discharge during dips (transients) in the power line voltage (i.e. voltage produced by AC source 100). Discharge of capacitor C3 occurs whenever the power line voltage is insufficient to maintain lamp load 20 lit. Once capacitor C3 has sufficiently discharged, timer TI can be reset. In other words, capacitor C3 in combination with resistor R4 senses (i.e. detects) when voltage dips (transients) sufficient to turn OFF lamp load 20 occur permitting the timer TI to be reset. With timer TI reset, lamp load 20 can be restarted following a voltage dip even though the line voltage has not dropped to a substantially zero level. In contrast thereto, conventional shut-off type ballast ignitors, such as disclosed in U.S. Pat. No. 5,070,279, require the line voltage to be removed (i.e. reduced to approximately a zero voltage level) and then be reapplied to the ballast in order to reset the timer and thereby activate ignitor 120.

As can be readily appreciated, voltage sensor/timer unit 130 can be designed as a separate module to be used in conjunction with and detachably coupled to a typical HID lamp ignitor thereby controlling the ON/OFF status of ignitor 120. Unit 130 disables ignitor 120 after a predetermined period of time has elapsed in the event lamp load 20 fails to ignite. By detecting voltage dips in line voltage and resetting timer TI whenever a dip in line voltage sufficient to turn OFF lamp load 20 occurs, (i.e. a dip in the voltage produced by AC voltage source 100), ballast 10 is capable of restarting lamp load 20 following restoration of the line voltage regardless of whether or not the line voltage has dipped to a substantially zero level.

In accordance with one preferred embodiment of the invention, for ballasting an HID lamp of the high pressure sodium type, nominally rated at 100 volts, 400 watts, voltage source 100 supplies approximately 277 volts RMS across primary winding PW with tap TP1 being at 120 volts. Sidac SI has an approximately 240 volt breakover voltage. Capacitor C1 is nominally rated at 0.15 microfarads and resistor R1 is approximately 6K ohms. Resistors R2, R3, R4, R5, R6 and R7 are nominally rated at approximately 7.5K ohms, 2 watts; 430 ohms, ¼ watt; 3K ohms, ¼ watt; 3.6 megohms ¼ watt; 180 ohms, ½ watt; and 200 ohms, ¼ watt. Capacitors C1, C3 and C4 are nominally rated at 55 microfarads, 200 volts; 22 microfarads, 50 volts; and 47 microfarads, 10 volts. Diode bridge rectifier DB is a full wave rectifier available from Diodes, Inc. of San Bernadino, Calif. under Catalogue Number DB102. Timer TI is a LM 2905 type integrated circuit. Optocoupler OC is available from Sharp Electronics, Inc. of Tokyo, Japan under Catalogue Number S21MD7T. Based on the foregoing values, ignitor 120 produces pulses in the order of approximately 2.5–4 kilovolts.

As can be now also readily appreciated, ballast 10 includes an ignitor having a turn OFF timing feature. Unit 130 can be modular and used in combination with an entire family of ignitors. That is, unit 130 can be used with a family of ignitors which vary in ignition pulse amplitude and/or time during which the ignition pulses are applied to the lamp load. Preferably, tap TP1 of primary winding PW is a 120 volt tap which is based on the voltage divider network of resistors R2 and R3 and provides a voltage of approximately 6.5 volts to the AC input terminals of diode bridge rectifier DB. Ballast 10 particularly addresses and avoids the possibility of lamp load 20 not reigniting once the line voltage has been restored following a voltage dip between nodes A and B. In particular, resistor R4 allows smoothing capacitor C3 to discharge rapidly, typically within one cycle. Timer TI can then be reset and triggered whenever the voltage at tap TP1 returns to approximately 120 volts.

Operation of unit 130 need not be based on tap TP1 being at 120 volts. For example, a different primary winding voltage tap can be used by changing the resistances of resistors R2 and R3 to accommodate a different voltage tap. The countdown timing sequence determined by resistor R5 and capacitor C4 can also be varied. Different time delays, as desired, can therefore be produced while using the same printed circuit (PC) board for unit 130. Unit 130 can be used for any ballast that requires an ignitor.

Ballast 10 provides a relatively simple approach in providing a shut-off type ignitor. Unit 130 can be simply and easily added to any existing ballast. A single PC board can be used for unit 130. The same board can be used regardless of the type of HID lamp load to be ignited with the understanding that the time delay can be adjusted by changing the values of capacitor C4 and resistor R5. Unlike conventional shut-off type ignitors, ballast 10 is characterized by a power line voltage dip sensitivity so that lamp load 20 can be restarted immediately following restoration of the line voltage.

It will thus be seen that the objects set forth above and those made apparent from the preceding description are efficiently attained and, since certain changes can be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A ballast for powering a lamp load, comprising:

a power source for producing an output voltage;

ignition means for generating ignition pulses based on the output voltage;

timing means for controlling when the ignition pulses are to be generated; and voltage sensing means for automatically sensing whenever the output voltage is insufficient for lighting the lamp load followed by an output voltage sufficient for lighting the lamp load;

wherein said timing means, in response to said voltage sensing means sensing an output voltage insufficient for lighting the lamp load followed by an output voltage sufficient for lighting the lamp load, being operable for automatically initiating generation of the ignition pulses.

2. The ballast of claim 1, wherein said voltage sensing means is automatically operable for resetting and setting said timing means based on the output voltage being insufficient and sufficient for lighting the lamp load, respectively.

3. The ballast of claim 1, wherein said voltage sensing means includes a capacitor and resistor connected together in parallel.

4. The ballast of claim 1, further comprising switching means coupled in series with said ignition means across the lamp load.

5. The ballast of claim 2, wherein said voltage sensing means includes a capacitor and resistor connected together in parallel.

6. The ballast of claim 5, wherein said power source is connected across the lamp load.

7. The ballast of claim 2, further comprising switching means coupled in series with said ignition means across the lamp load.

8. The ballast of claim 3, wherein said timing means includes switching means for placing said ignition means in serial combination with said switching means across the lamp load.

9. The ballast of claim 8, wherein said timing means further includes a timing device and an optocoupler, said optocoupler being coupled between said timing device and said switching means.

10. The ballast of claim 9, wherein said switching means includes a triac having a gate connected to said optocoupler.

11. The ballast of claim 8, wherein said power source is connected across the lamp load.

12. The ballast of claim 1, wherein said lamp load comprises a high intensity discharge lamp and said voltage sensing means is connected to said power source for monitoring a predetermined portion of the output voltage.

13. The ballast of claim 1, wherein said power source includes a transformer having a primary winding with at least one tap, the voltage at the at least one tap being supplied to said voltage sensing means.

14. The ballast of claim 1, wherein said timing means includes means for measuring when a predetermined period of time has elapsed, said timing means in response to the elapsed predetermined period of time being operable for interrupting generation by said ignition means of said ignition pulses.

15. The ballast of claim 2, wherein said timing means includes means for measuring when a predetermined period of time has elapsed, said timing means in response to the elapsed predetermined period of time being operable for interrupting generation by said ignition means of said ignition pulses.

16. The ballast of claim 1, wherein said timing means and said voltage sensing means are integrally connected together as one unit, said unit being detachably coupled to said ignitor means.

17. The ballast of claim 3, wherein said timing means and said voltage sensing means are integrally connected together as one unit, said unit being detachably coupled to said ignitor means.

18. A method for ballasting a lamp load, comprising:

producing a lamp voltage;

generating ignition pulses for igniting the lamp load;

controlling when the ignition pulses are to be applied to the lamp load; and sensing whenever the lamp voltage is sufficient and insufficient to light the lamp load;

wherein, in response to sensing a lamp voltage insufficient to light the lamp load followed by a lamp voltage sufficient to light the lamp load, automatically generating ignition pulses for ignition of the lamp load.

19. The method of claim 18, further including measuring when a predetermined period of time has elapsed for generating ignition pulses and in response thereto interrupting generation of the ignition pulses.

20. An ignitor-timer circuit for a discharge lamp comprising:

ignition means for generating ignition pulses based on the output voltage;

timing means for controlling when the ignition pulses are to be generated;

output terminals coupled to a source of AC voltage and adapted for connection to a discharge lamp;

first means for coupling said ignition means and said timing means to the source of AC voltage and to said output terminals for igniting a connected discharge lamp;

voltage sensing means arranged to sense a short duration dip in the output voltage sufficient to extinguish a connected discharge lamp followed by an increase in the output voltage sufficient to maintain a discharge lamp in a lit condition; and second means for coupling said voltage sensing means to input means of said timing means so that said timing means, in response to a signal voltage supplied to it by said voltage sensing means when the voltage sensing means senses said short duration dip in the output voltage followed by said increase in the output voltage, is reset to initiate the generation of the ignition pulses by said ignition means.

21. The ignitor-timer circuit as claimed in claim 20, wherein said voltage sensing means has a time constant that is shorter than one cycle of said AC voltage source.

22. The ignitor-timer circuit as claimed in claim 20, further comprising a controlled bidirectional switching device controlled by said timing means and connected in series circuit with at least a part of said ignition means to said output terminals, and wherein said voltage sensing means senses short duration voltage dips which may occur when a connected discharge lamp is in its normal operating state.

23. The ignitor-timer circuit as claimed in claim 20 wherein said timing means includes a timing circuit which, after a predetermined time period of operation of the timing means, generates a control signal that interrupts the generation of said ignition pulses by said ignition means.

24. An ignitor-timer circuit for a discharge lamp comprising:

ignition means for generating ignition pulses based on the output voltage;

timing means for controlling when the ignition pulses are to be generated;

output terminals coupled to a source of AC voltage and adapted for connection to a discharge lamp;

first means for coupling said ignition means and said timing means to the source of AC voltage and to said output terminals for igniting a connected discharge lamp;

voltage sensing means which, during normal operation of a connected discharge lamp, senses a short duration dip in the output voltage sufficient to extinguish a connected discharge lamp; and second means for coupling said voltage sensing means to said timing means to supply a reset signal to the timing means when the voltage sensing means senses said short duration dip in the output voltage, whereby the timing means controls the ignition means to initiate the generation of said ignition pulses.

25. The ignitor-timer circuit as claimed in claim 24 wherein said discharge lamp comprises a high intensity discharge lamp, said ignition pulses being operable to automatically reignite a connected high intensity discharge lamp when the output voltage increases to a voltage level sufficient to maintain an arc in the high intensity discharge lamp and without prior removal and reapplication of said source of AC voltage from and to the ignitor-timer circuit, respectively.

26. The ignitor-timer circuit as claimed in claim 24 wherein said voltage sensing means has a time constant which allows it to respond to short duration voltage dips that are shorter in time duration than the time period for one cycle of the AC voltage source.

27. The ignitor-timer circuit as claimed in claim 24 wherein said timing means and said voltage sensing means comprise an integral unit of an integrated circuit, said integral unit being adapted to be detachably coupled to said ignition means.

28. The ignitor-timer circuit as claimed in claim 26 wherein said time constant is determined by an RC circuit of the voltage sensing means.

* * * * *